United States Patent [19]

Hart

[11] Patent Number: 4,715,291

[45] Date of Patent: Dec. 29, 1987

[54] RAILROAD CAR DOOR BOTTOM GUIDE RAIL SYSTEM

[75] Inventor: James D. Hart, Grove City, Pa.

[73] Assignee: Trinity Industries, Inc., Dallas, Tex.

[21] Appl. No.: 881,332

[22] Filed: Jul. 2, 1986

[51] Int. Cl.[4] ..... B61D 3/18; B60J 5/14

[52] U.S. Cl. ..... 105/378; 160/201

[58] Field of Search ..... 105/378, 410; 49/410, 49/411; 410/26; 160/196 R, 199, 201, 206; 16/90, 91, 96 R

[56] References Cited

U.S. PATENT DOCUMENTS

| | | | |
|---|---|---|---|
| 1,068,320 | 7/1913 | Christy | 105/378 X |
| 3,054,447 | 9/1962 | Brydolf | 160/206 |
| 3,995,563 | 12/1976 | Blunden | 105/378 |
| 4,116,135 | 9/1978 | Jaekle et al. | 160/196 R X |
| 4,260,046 | 4/1981 | Seitz | 105/378 X |
| 4,437,410 | 3/1984 | Stoller, Sr. et al. | 105/378 |

*Primary Examiner*—Robert B. Reeves
*Assistant Examiner*—Scott H. Werny
*Attorney, Agent, or Firm*—Webb, Burden, Robinson & Webb

[57] ABSTRACT

A railroad car arranged to transport vehicles includes a floor, a roof, a pair of spaced side walls and at least one door assembly suspended for movement from a closed position at an end of the car to an open position adjacent a side wall for the loading and unloading of vehicles thereon. A plurality of fingers attached to the bottom edges of the door assembly straddle a rail and provide slidable movement of the door assembly relative thereto. A portion of the rail is positioned on a platform attached to an end of the railroad car a spaced distance below and in parallel relation to the floor. The upper edge of the rail on the platform does not extend above the level of the floor at least in the areas through which the tires of a vehicle pass during loading and unloading of the railroad car.

11 Claims, 7 Drawing Figures

RAILROAD CAR DOOR BOTTOM GUIDE RAIL SYSTEM

FIELD OF THE INVENTION

This invention relates to the field of railroad cars adapted to carry vehicles, especially automobiles. More particularly, the invention is directed to railroad car door bottom guides.

BACKGROUND OF THE INVENTION

For railroad cars adapted to carry vehicles such as automobiles, it is essential that the cargo be enclosed to protect it from theft of components. Such railroad cars are provided with side walls, a roof spanning the side walls and ends that are closed off by doors or door assemblies. Typically, the railroad cars are designed to have a floor and either one or two intermediate decks supported above the floor for holding the vehicles loaded thereon. The vehicles are driven over ramps detechably mounted to an end of the railroad car onto either the floor or deck for loading.

The height of the railroad car is a critical matter. Due to limitations (underpasses, tunnels and the like) along the railway, the overall height of the railroad car is restricted. Especially in the case of cars designed for three levels, i.e., having two decks supported above the floor, the total height of vehicle carried is limited by the height of the railroad car roof above the floor and by the distance between decks. A savings of two or three inches can be of great significance.

A number of end closure (door) designs are known for railroad cars of the type being discussed. Usually, the door assemblies attach to fingers and slide from a closed position to an open position along the inside of the side walls on a suitable guide track or rail that is provided adjacent the bottom edges of the door assemblies. The guide rail does not hinder the operation of the door assemblies; rather; it provides security to the railroad car contents. Where the fingers straddle the guide rail, access may not be gained to the railroad car interior by pulling the bottom edges of a door assembly out and away from an end opening.

Typically, the guide rail of a prior art railroad car extends upwardly from the floor at an end of the car. This extension of guide rail undesirably wastes from two or three inches of effective distance between the floor and intermediate deck of the railroad car. Actually, where it is necessary to bridge the guide rail with a platform, ramp or the like, the floor-to-deck distance is even further diminished.

It is an advantage according to this invention to provide a railroad car adapted to carry vehicles having an end closure with a door bottom guide rail system that does not diminish the effective distance between floor and intermediate deck of the railroad car while maintaining the security of its contents. A similar result has been achieved in several commonly owned, pending U.S. applications. In Ser. No. 783,943, filed Oct. 3, 1985, now U.S. Pat. No. 4,688,490, a continuous, uninterrupted door guide rail for a railroad car is provided with two spring-biased rail sections. These rail sections depress into recesses in the railroad car floor when vehicle tires pass over them during loading and unloading. In Ser. No. 819,408, filed Jan. 14, 1986, now U.S. Pat. No. 4,646,652, a door bottom guide system is provided with a rail having two interrupted portions through which the tires of a vehicle pass during loading and unloading. The door assemblies of said application, when in their closed position, are secured at the interrupted portions by pin mechanisms and correspondingly sized apertures in the railroad car floor.

SUMMARY OF THE INVENTION

Briefly, there is provided an improved railroad car arranged to transport vehicles such as automobiles. The railroad car includes a floor, a roof, and a pair of spaced side walls. At least one door assembly and means for suspending the door assembly are positioned adjacent an end opening of the railroad car. The suspension means allows for movement of the door assembly from a closed position at the end of the railroad car to an open position adjacent a side wall for the loading and unloading of vehicles thereon. A rail for securing the bottom edges of the door assembly is also provided. A plurality of fingers attached to the bottom edges of the door assembly, straddle this rail and provide slidable movement of the door assembly relative to the rail.

The improvement according to the invention is that a portion of the rail is positioned on a platform attached to the end of the railroad car a spaced distance below and in parallel relation to the floor. This rail portion does not extend above the level of the railroad car floor, but rather below or to the level of the floor at least in the areas through which the tires of a vehicle pass during loading and unloading of the railroad car.

The door assembly of the invention further includes a plurality of long door sections and a plurality of shorter door sections. The floor of the railroad car includes a section extending outwardly from the end of the railroad car between the areas through which the tires of a vehicle pass during loading and unloading. A rail segment attaches to this floor section. A plurality of spaced fingers attached to the bottom edges of the shorter door sections straddle this rail segment when the door assemblies are in a closed position.

Most preferably, the invention includes means for guiding the fingers attached to the shorter door sections onto the rail segment when the door assembly is moved into its closed position. The guide means include a pair of spaced members attached to the extended floor section at each end of the rail segment. Each spaced member is angled towards and extends slightly beyond a finger receiving end of the rail segment. Most preferably, each spaced member is located at between about a 30°–45° angle relative to the finger receiving end of the rail segment.

The improvement herein teaches a railroad car having a door bottom guide rail system wherein a portion of the rail is positioned on a platform attached a spaced distance below the end of the railroad car and parallel to the floor so that the upper edge of the rail extends below or to the level of the floor at least in the areas through which the tires of a vehicle pass during loading and unloading thereon. The improvement provides several alternatives to railroad car door bottom guide systems having interrupted rail portions or depressible rail sections. This invention provides for greater security of contents since the fingers attached to the bottom edges of the door assemblies herein continuously contact with and straddle a non-depressible rail when the door assemblies are in a closed position and ready for transport.

BRIEF DESCRIPTION OF THE DRAWINGS

Further features and other objects and advantages of this invention will become clear from the following detailed discussion made with reference to the drawings in which.

DETAILED DESCRIPTION OF THE INVENTION

Figure 1:
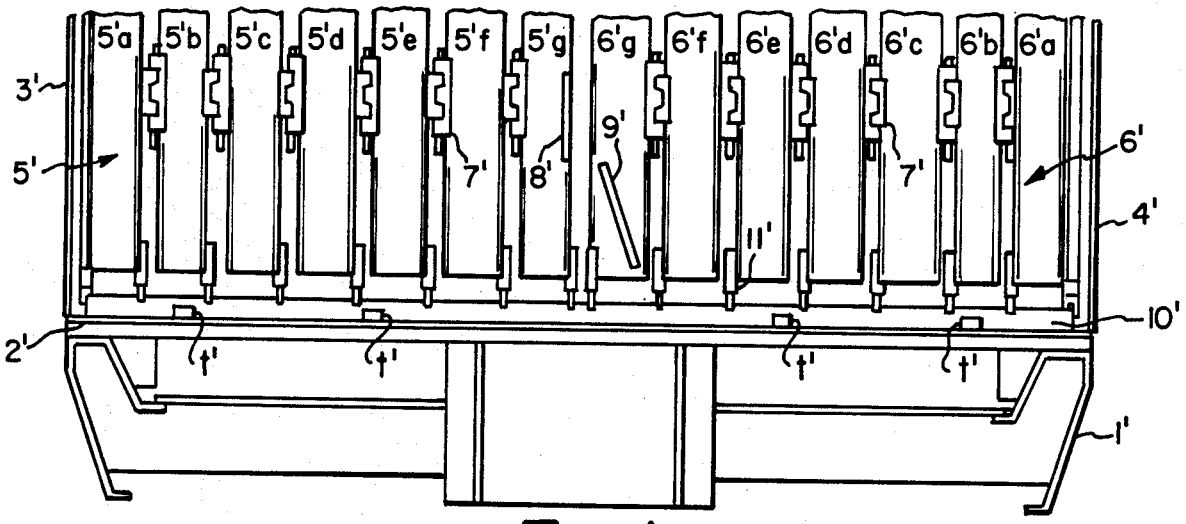
Fig. 1 PRIOR ART
FIG. 1 is an end view of a portion of a prior art railroad car exterior above the frame.

FIG. 1 is an end view of a portion of a prior art railroad car exterior above the frame. Typically, a railroad car designed to carry vehicles, such as automobiles, includes a frame 1' upon which is positioned a floor 2'. For simplicity, the wheels and axles of the railroad car are not shown. Side walls 3', 4' rise from the floor 2' and are spaced apart the width of the railroad car. A roof, also not shown, spans the space between side walls 3', 4'. Tube sections t' are welded in pairs to the edge of frame 1' or to floor 2'. These tube sections form the fixed portion of a hinge which, together with a rod and intermediate tube section, temporarily align and secure bridge platforms or ramps to the railroad car. Vehicles are driven over these ramps onto either the floor or an intermediate deck during loading and unloading of the railroad car.

Door assemblies 5', 6' are arranged to close off the end opening of the typical railroad car. Alternatively, a single door assembly may be used at one or both ends of the car. Door assemblies 5', 6' are arranged to slide back along the inside of side walls 3', 4', respectively, to their open or stowed positions for loading and unloading. As shown, each door assembly comprises a plurality of long, thin upright sections, 5'*a* through 5'*g*; 6'*a* through 6'*g*. Adjacent sections are hinged together at the top, middle and bottom by a plurality of pin and hinge assemblies 7'. The door assembly sections may be made of rigid, steel channels or any other suitable material.

Door assemblies 5', 6' are brought together to the center of the railroad cars for closing and securement during transport. Handles 8', 9' are used for this purpose. Once joined together, door assemblies 5', 6' may be further secured by an interlocking door mechanism known in the art. The means for suspending the door assembly for movement from a closed position at an end of the railroad car to an open position adjacent a side wall, also referred to as the support member (not shown), is generally arranged midway between the floor and roof of the railroad car. Various roof configurations and support members have been designed depending upon the type of door assembly employed. The particular construction of interlocking mechanism, roof and support member, however, form no part of the present invention.

With the type of door assembly described above, there is provided a guide track or rail, genrally 10', which permanently attaches to and extends above floor 2'. A plurality of fingers 11' are attached to the bottom edges of door assemblies 5', 6'. These fingers 11' contact with and straddle rail 10' and are in sliding engagement therewith. Together, fingers 11' and rail 10' act as means for securing the contents of the railroad car. Where the fingers straddle the rail, the bottom edges of the door assemblies cannot be forced outwardly and away from an end opening. Hence, unauthorized access to the railroad car interior is prevented.

In the prior art railroad car illustrated in FIG. 1, rail 10' extends without interruption from side to side of the end opening. The ends of rail 10' then curve around and along the floor adjacent a portion of each side wall. This arrangement allows the door assemblies to remain on the rail when moved to their open position. Because of the presence of rail in the areas over which the tires of a vehicle pass during loading and unloading, the effective distance between floor 2' and the intermediate deck is undesirably diminished by two or three inches. When ramps connect to tube sections t' for the loading and unloading of vehicles thereon, the overlap of a ramp with rail 10' further diminishes the amount of usable space between railroad car levels. It is a primary object of this invention to eliminate this waste of effective railroad car height.

Figure 3:
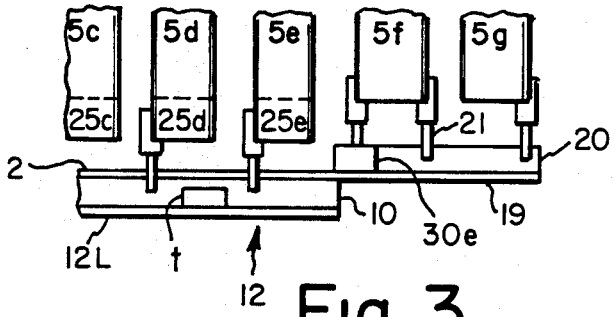
FIG. 3 is an exploded view of a portion of FIG. 2.
Figure 4:
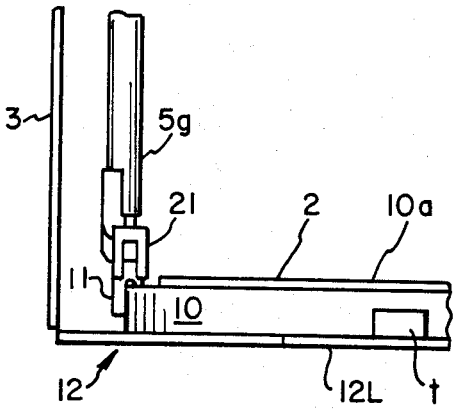
FIG. 4 is an end view of a portion of FIG. 2 with the door assembly in an open position.
Figure 5:
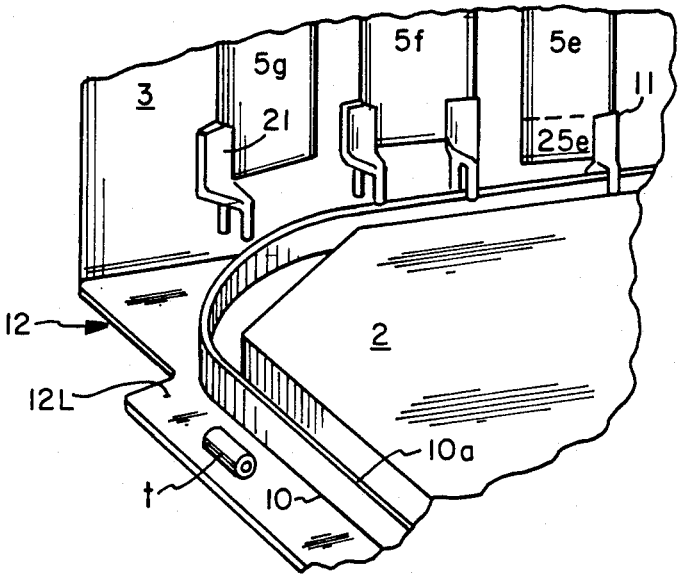
FIG. 5 is a perspective view of FIG. 4.
Figure 2:
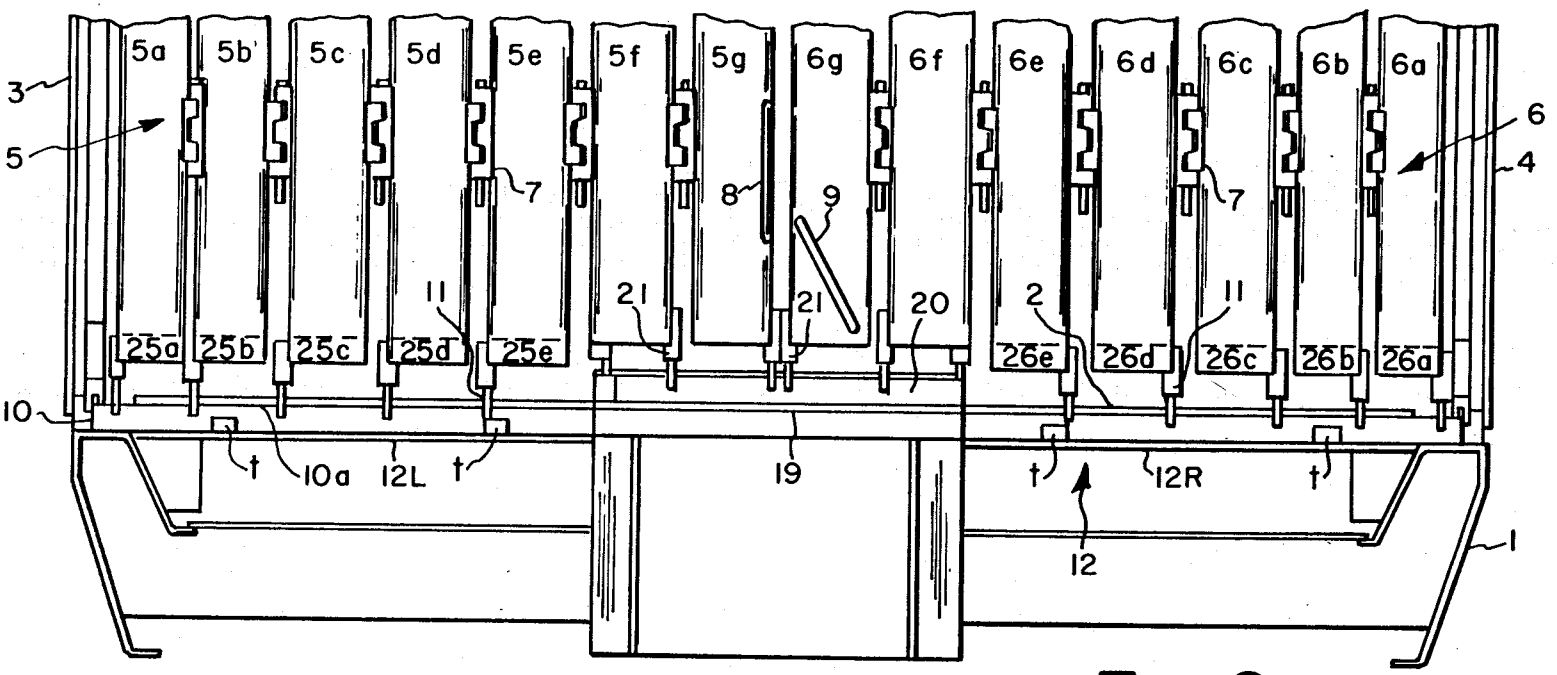
FIG. 2 is an end view of a portion of a railroad car exterior above the frame according to the invention.

Referring to FIGS. 2–7, there is shown a portion of the end of a railroad car according to the invention. Like the car of the prior art, the invention includes a frame 1 upon which is positioned a floor 2 and a pair of spaced side walls 3, 4 spanned by a roof, not shown. Door assemblies 5, 6 are suspended by a support member to close off the end opening of the car. The doors may also slide back along the inside of side walls 3, 4 to an open position for the loading and unloading of vehicles thereon. Each door assembly comprises a plurality of long, thin upright sections, 5*a* through 5*e*, 6*a* through 6*e*, and a plurality of shorter door sections 5*f*, 5*g*, 6*f* and 6*g*. As shown in FIGS. 2, 3 and 5, the long door sections are essentially shorter sections with extensions 25*a*–25*e*, 26*a*–26*e* added thereon to form sections 5*a*–5*e*, 6*a*–6*e*, respectively. Alternatively, long door sections 5*a*–5*e*, 6*a*–6*e* may be constructed as separate and independent units rather than by adding extensions to existing shorter sections. Adjacent door sections are hinged together at the top, middle and bottom by a plurality of pin and hinge assemblies 7. Handles 8, 9 are used to move the door assemblies between open and closed positions. Once joined together, the door assemblies 5, 6 may be further secured by any known interlocking door mechanism.

The improvement of this invention particularly concerns the location of rail 10. Specifically, a portion of rail 10 extends from a platform 12 attached to frame 1 a spaced distance below and in parallel relation to floor 2. When a portion of guide track or rail is positioned on a lowered platform as described herein, the upper edge of this rail portion will not extend above the level of floor 2 at least in the areas through which the tires of a vehicle pass during loading and unloading. When platform 12 is positioned a distance of between about 2 to 3 inches below floor 2, the upper edge 10*a* of rail 10 extends either slightly below or to the level of floor 2. Tube sections t, which are used in conjunction with rods and intermediate tube sections to align and secure ramps to the railroad car, are attached to platform 12 adjacent rail 10. The mounting of tube sections in this manner preserves the amount of effective height gained by positioning rail 10 below the level of floor 2.

Figure 6:
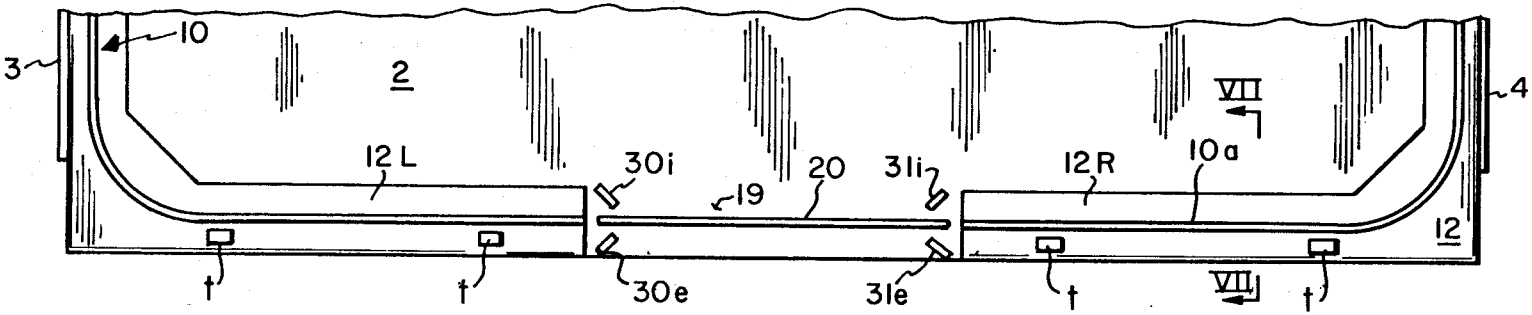
FIG. 6 is a plan view of the end of the railroad car shown in FIG. 2 with the door assemblies removed.

Floor 2 of the invention further includes a section 19 that extends outwardly from the end of the railroad car between the areas through which the tires of a vehicle pass during loading and unloading. As shown in FIGS. 2 and 6, section 19 extends outwardly between platform 12 to divide same into two portions 12L, 12R, which are spaced apart the width of section 19. Each portion of platform 12L, 12R extends inwardly from the lower end of a side wall to about the adjacent edge of section 19. The railroad car is not limited to the above configuration, however. Alternatively, platform 12 may extend completely across the railroad car end and between side walls 3, 4 with section 19 extending outwardly thereabove.

Figure 7:
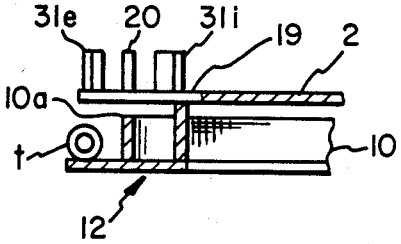
FIG. 7 is a sectional view of FIG. 6 taken along lines VII—VII.

A rail segment 20 attached to section 19 and extends above the level of floor 2 between the ares through which the tires of a vehicle pass. Most preferably, rail segment 20 on platform 12 and rail 10 are located in the same vertical plane as shown in FIG. 7. A plurality of fingers provide the slidable movement of door assemblies 5, 6 relative to both rail 10 and rail segment 20 of the invention. More particularly, fingers 11 attached to the long door sections of door assemblies 5, 6 straddle rail 10; fingers 21, attached to bottom edges of shorter door sections 5*f*, 5*g*, 6*f* and 6*g* straddle rail segment 20 when the door assemblies are in a closed position and ready for transport. When fingers 11 straddle rail 10 and fingers 21 straddle rail segment 20, the door assemblies cannot be forced outwardly and away from the end opening of the railroad car. Hence, the contents of the railroad car are secured with the door assemblies in their closed positions.

As illustrated in FIGS. 4 and 5, fingers 21 do not contact with or straddle either rail 10 or rail segment 20 when the door assemblies are slid to their open position adjacent side walls 3, 4. Hence, when door assemblies 5, 6 are moved into their closed position, means for guiding fingers 21 onto rail segment 20 must be provided. Preferably, the guide means include a pair of spaced members 30, 31 attached to section 19 at each end of rail segment 20 which is designed to receive fingers 21 thereon. Each of said members 30, 31 comprises an interior and an exterior portion, designated by "i" or "e", respectively, which may be flat, curved or angled. Said members also angle toward and extend slightly beyond the finger receiving ends of rail segment 20. Most preferably, spaced members 30, 31 are located at between about a 30°–45° angle relative to each finger receiving end of rail segment 20.

Having thus described the invention with the detail and particularity required by the patent laws, what is desired protected by Letters Patent is set forth in the following claims.

I claim:

1. In a railroad car arranged to transport vehicles, a floor; a roof; a pair of spaced side walls; at least one door assembly; means for suspending said door assembly for movement from a closed position at an end of said railroad car to an open position adjacent a side wall for the loading and unloading of vehicles thereon; a rail for securing the bottom edges of said door assembly; and a plurality of spaced fingers attached to the bottom edges of said door assembly to straddle said rail and provide slidable movement of said door assembly relative to said rail, the improvement comprising:

a platform attached to said end of said railroad car extending along at least one side of said railroad car and positioned between a lower end of a side wall and an adjacent edge of said floor, said platform spaced a distance below and in parallel relation to said floor, a portion of said rail being positioned on said platform so that the upper edge of said portion of rail does not extend above the level of said floor at least in areas through which the tires of a vehicle pass during loading and unloading of said railroad car, whereby said door assembly may be moved along the rail adjacent to and inside of said side walls to an open position for the loading and unloading of vehicles thereon.

2. The improvement set forth in claim 1 wherein said platform is spaced between about 2 to 3 inches below said floor.

3. In a railroad car arranged to transport vehicles, a floor; a roof; a pair of spaced side walls; at least one door assembly comprised of a plurality of long door sections and a plurality of shorter door sections; means for suspending said door assembly for movement from a closed position at an end of said railroad car to an open position adjacent a side wall for the loading and unloading of vehicles thereon; a rail for securing the bottom edges of said long door sections; and a plurality of spaced fingers attached to the bottom edges of said long door sections to straddle said rail and provide slidable movement of said door assembly relative to said rail, the improvement comprising:

a platform attached to said end of said railroad car extending along at least one side of said railroad car and positioned between a lower end of a side wall and an adjacent edge of said floor, said platform spaced a distance below and in parallel relation to said floor, a portion of said rail being positioned on said platform so that the upper edge of said portion of rail does not extend above the level of said floor at least in the areas through which the tires of a vehicle pass during loading and unloading of said railroad car, whereby said door assembly may be moved along the rail adjacent to and inside of said side walls to an open position for the loading and unloading of vehicles thereon.

4. The improvement set forth in claim 3 wherein the upper edge of said portion of rail extends to the level of said floor in the areas through which the tires of a vehicle pass during loading and unloading of said railroad car.

5. The improvement set forth in claim 3 wherein said floor includes a section extending outwardly from said end of said railroad car between the areas through which the tires of a vehicle pass during loading and unloading of said railroad car and said railroad car further comprises:

a rail segment attached to said floor section; and a plurality of spaced fingers attached to the bottom edges of said shorter door sections to straddle said rail segment on said floor section when said door assembly is in said closed position.

6. The improvement set forth in claim 5 wherein said floor section extends outwardly above said platform between the areas through which the tires of a vehicle pass during loading and unloading of said railraod car.

7. The improvement set forth in claim 5 wherein said platform is comprised of two portions spaced apart by the width of said floor section, each of said portions of said platform extending inwardly from the lower end of a side wall to about an adjacent edge of said floor section.

8. The improvement set forth in claim 5 wherein said rail on said platform and said rail segment on said floor section are located in the same vertical plane.

9. The improvement set forth in claim 5 including means for guiding said fingers attached to said shorter door sections onto said rail segment when said door assembly is moved into said closed position.

10. The improvement set forth in claim 9 wherein said guide means includes a pair of spaced members attached to said floor section at each end of said rail segment, each of said members being angled toward and extending slightly beyond a finger receiving end of said rail segment.

11. The improvement set forth in claim 10 wherein each of said members is located at between about a 30°–45° angle relative to said finger receiving end of said rail segment.

* * * * *